United States Patent [19]

Wolford

[11] 4,178,829

[45] Dec. 18, 1979

[54] POWER TUBE FOR FLARED BELL MUSICAL INSTRUMENTS

[76] Inventor: John W. Wolford, P.O. Box 1024, Dundee, Fla. 33838

[21] Appl. No.: 909,057

[22] Filed: May 24, 1978

[51] Int. Cl.[2] ..... G10D 9/00

[52] U.S. Cl. ..... 84/386; 84/453

[58] Field of Search ..... 84/380 R, 380 A, 380 C, 84/381, 382, 385 R, 386, 400

[56] References Cited

U.S. PATENT DOCUMENTS

| | | | |
|---|---|---|---|
| 51,363 | 12/1865 | Stratton | 84/400 |
| 982,732 | 1/1911 | Lehnert | 84/387 |
| 1,702,561 | 2/1929 | Santa Emma | 84/400 |
| 1,729,336 | 9/1929 | France | 84/400 |
| 2,621,553 | 12/1952 | Daoust | 84/400 |
| 3,558,797 | 1/1971 | Wolford | 84/384 |

*Primary Examiner*—Lawrence R. Franklin

*Attorney, Agent, or Firm*—Duckworth, Hobby, Allen & Pettis

[57] ABSTRACT

A power tube is attachable within the bell end of a flared bell musical instrument for improving the musical sound of the instrument and for making the instrument easier to play. The power tube includes a hollow tubular member having a central axis aligned with the central axis of the instrument and including first and second open ends. The first end of the member forms an air tight seal with the interior of the instrument at a point just prior to the point where the flare of the bell of the instrument commences its rapid, outward sweep. The power tube includes a pair of diametrically opposed vents positioned near the first end.

7 Claims, 6 Drawing Figures

FIG. 1
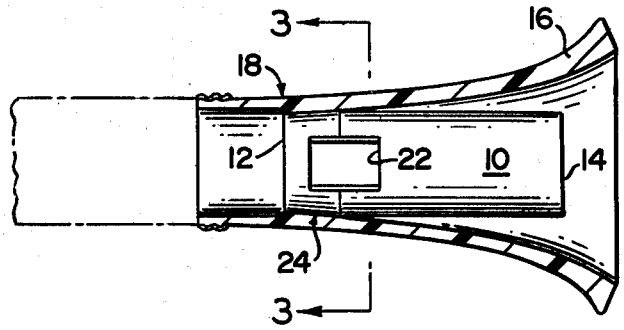
FIG. 2
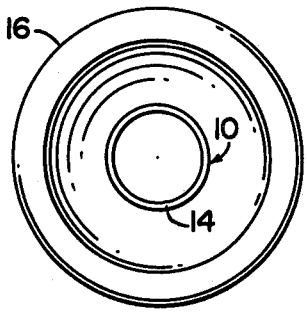
FIG. 3
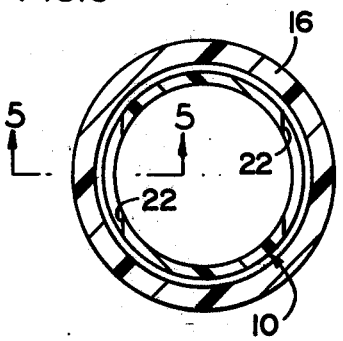
FIG. 4
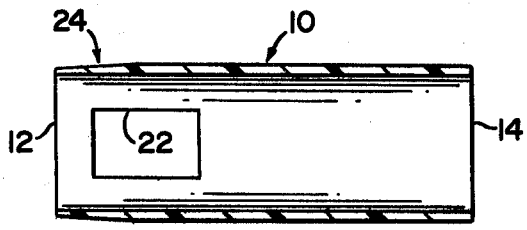
FIG. 5
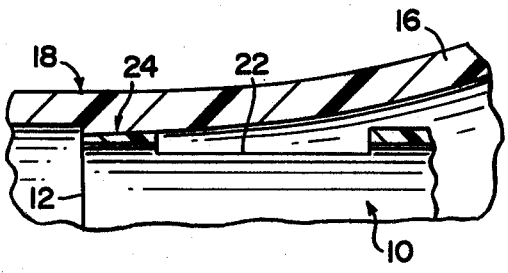
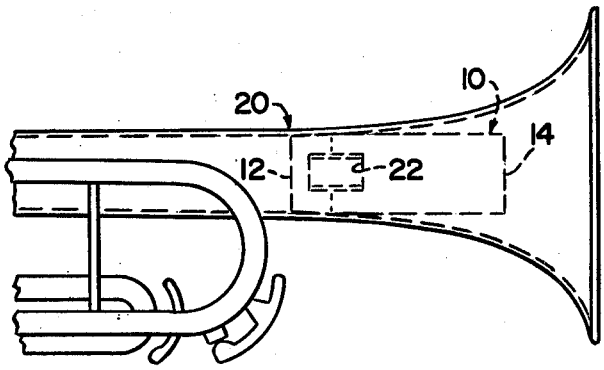
FIG. 6

POWER TUBE FOR FLARED BELL MUSICAL INSTRUMENTS

BACKGROUND OF THE INVENTION

1. Field of the Invention

The present invention relates to musical instruments and, more particularly, to a modification of the bell end of a flared bell instrument for improving the sound and playability of the instrument.

2. Description of the Prior Art

Musicians who play flared bell instruments such as clarinets, oboes, and trumpets must develop specialized and difficult techniques for overcoming the inherent shortcomings of these instruments. The high end of the musical scale generally includes the third harmonic tones of the instrument. In this frequency range, the sound output of the instrument is noticibly attenuated and uniform pitch control becomes exceedingly difficult to maintain. A technique known as false fingering together with substantially increased lip pressures are required to artificially compensate for the drop in sound output at the high end of the music scale. Without false fingering and other techniques difficult to master, tones created by the instrument crack and have a harsh sound. At the upper end of the scale of a flared bell instrument wolf tones (undesirable lower harmonic frequency tones) appear which also detract from the overall sound quality of the instrument.

While the prior art contains a substantial number of tone modification and volume attenuation devices, no one has produced a device for dealing with the above mentioned difficulties encountered by flared bell instruments.

U.S. Pat. No. 1,729,336 (France) discloses a key change accessory which is tightly sealed within the bell of a flared bell instrument such as a trumpet. The substantial bore change produced by the insertion of this device into the bell of the trumpet can cause a B flat trumpet to sound like a C trumpet. U.S. Pat. No. 51,363 (Stratton) teaches a related cylindrical insert for the bell end of a trumpet which restricts the air column in the bell and effectively mutes the sound output from the trumpet. Other muting devices for trumpets are disclosed in the following U.S. Pat. Nos.: 1,307,259 (Kidder); 1,435,173 (Pappalardi); 1,714,513 (Magosy) and 3,842,706 (Beversdorf).

U.S. Pat. Nos. 1,350,409 (Humes) and 1,362,326 (Kidder) disclose sound modification devices which include a diaphragm for producing a reedy sound.

U.S. Pat. No. 3,558,797 (Wolford) discloses a recorder having a vibration box connected at the upper end of the bell section. The bell section also includes a straight cylindrical extension for providing proper operation of the vibration box. The vibration box and the cylindrical core of the bell function as a unit to create the desired vibratory output from the recorder.

SUMMARY OF THE INVENTION

It is the principle object of the present invention to provide a power tube for instruments having a flared bell end which produces substantially improved tonal qualities particularly at the high end of the scale and which provides a more uniform output volume over the total frequency range of the instrument.

Another object of the present invention is to provide a power tube for flared bell instruments which neither mutes the sound output nor changes the pitch of the instrument.

Still another object of the present invention is to provide a power tube for flared bell instruments which eliminates the requirement for false fingering at the high end of the scale.

Yet another object of the present invention is to provide a power tube for flared bell instruments which eliminates cracking and wolf tones at the upper end of the scale.

Briefly stated, and in accord with one embodiment of the invention, a power tube can be attached or fabricated within the bell end of a flared bell musical instrument. The power tube includes a hollow tubular member having first and second open ends and a central axis which is oriented generally parallel to the central axis of the flared bell instrument. The first end of the tubular member forms an air tight seal with the interior of the instrument at a point just prior to the point where the bell commences its rapid, outward sweep. The tubular member also includes a pair of diametrically opposed vents positioned near the first end.

DESCRIPTION OF THE DRAWING

The invention is pointed out with particularity in the appended claims. However, other objects and advantages together with the operation of the invention may be better understood by reference to the following detailed description taken in conjunction with the following illustrations, wherein:

FIG. 1 is a partial sectional view of the bell of a clarinet showing a power tube of the present invention inserted therein.

FIG. 2 is an end view of the structure illustrated in FIG. 1.

FIG. 3 is a sectional view of the power tube and clarinet bell taken along section line 3—3.

FIG. 4 is a sectional view of a power tube of the present invention.

FIG. 5 is a partial sectional view of the power tube illustrated in FIG. 3, taken along section line 5—5.

FIG. 6 illustrates the proper positioning of a power tube of the present invention within the bell end of a trumpet.

DETAILED DESCRIPTION OF THE INVENTION

In order to better illustrate the advantages of the invention and its contributions to the art, the various mechanical features of the preferred embodiment will be reviewed in detail.

Referring now to FIG. 1, the primary structural element of the power tube of the present invention is a hollow tubular member 10 having a first end 12 and a second end 14.

The first end 12 of the power tube is designed to be inserted within the bell 16 of a clarinet to the point where the musical tube of the instrument terminates. In a clarinet this termination point occurs at the location indicated by reference number 18, which is the point to which the end of the preceding removable section of the instrument will be inserted when the clarinet is fully assembled. FIG. 6 indicates that the end of the musical tube of a brass instrument such as a trumpet occurs at the point indicated by reference number 20. The exact location of the first end of the power tube within the bell of a woodwind will vary with each different type of instrument, but the general rule is that the first end of tubular member 10 must be positioned just prior to the point where the bell commences its rapid, outward sweep. This point at which the outward flair of the bell commences defines the end of the musical tube of the instrument.

In the preferred embodiment of the invention described in connection with the clarinet illustrated in FIG. 1, power tube 10 is fabricated from a three inch length of plastic tubing having a one inch outer diameter and a wall thickness of approximately 1/16 inch. Since the inner diameter of the clarinet bell at the point indicated by reference number 18 is approximately 0.998 inches, the first end of power tube 10 must be chamfered as indicated in FIG. 4 at reference number 24. Chamfered end 22 of power tube 10 can be secured in place in the bell 16 of the clarinet by either a friction fit or by an adhesive bond.

A pair of diameterically opposed vents, such as vent 22, are disposed in the sides of power tube 10. Each of these two vents are identical in size and are typically located less than about one quarter inch from first end 12 of power tube 10. In the preferred embodiment used in connection with a clarinet, each slot has a width of five eights of an inch and a length of seven eights of an inch. It is important that all the edges on the two slots and the two ends of the power tube are smoothly rounded to provide the optimum tonal qualities for the device.

The power tube of the present invention can be used with all flared bell instruments having bell ends, such as clarinets, oboes, trumpets and trombones. Woodwinds such as a flute that do not include a bell end are incompatible with the present invention. Various design changes and small modifications of the present invention will be required to adapt the preferred embodiment to each distinct use, however, the general design and fabrication principles explained above still apply.

It has been found that the adaption of a power tube of the present invention to a clarinet neither mutes nor alters the overall tonal qualities of the instrument. A uniform output volume can readily be maintained from the low end to the high end of the musical scale of the instrument. Pitch control is facilitated and false fingering is not required to avoid undesirable intonation levels. The sound output from the instrument is uniformly pleasing and totally lacks the harshness normally associated with conventional prior art instruments. A substantially greater amount of power output is available at the upper end of the frequency range of the musical instrument and a player is able to create this substantially increased output volume without increasing lip pressure or forcing increased amounts of air through the instrument. Cracking and wolf tones are substantially eliminated at the upper end of the scale.

In typical use with a clarinet, the power tube of the present invention will be molded into the bell end of the instrument as a single unit during manufacture of the clarinet. For larger flared bell instruments, such as trumpets and trombones, the power tube will typically be an attachment which can be inserted into and removed from the bell. This device may also be manufactured as an attachment for an existing instrument to permit insertion and removal from the end of the bell.

It will be apparent to those skilled in the art that the disclosed power tube for flared bell may be modified in numerous ways and may assume many embodiments other then the preferred form specifically set out and described above. Accordingly, it is intended by the appended claims to cover all such modifications of the invention which fall within the true spirit and scope of the invention.

I claim:

1. A power tube for attachment within the bell of a flared bell musical instrument, said power tube comprising a hollow tubular member of a substantially constant inner diameter and open at both ends, said tubular member having first and second parallel oriented circular end surfaces aligned perpendicular to the longitudinal axis of said tube, the outer surface of the first end surface forming an airtight seal with the interior surface of the bell at a point just prior to the point were the bell commences its rapid outward sweep, said tube having a length such that the second end surface is positioned within the interior of said bell and an interior wall aligned at a constant angle with respect to the longitudinal axis of said tube, said tube including a pair of diametrically opposed vents positioned in close proximity to the first end surface which provide fluid communication between the exterior wall of said tube and the interior surface of said bell to permit a flow of air from said space into the interior volume of said tube.

2. The power tube of claim 1 wherein said vents are rectangular vents.

3. The power tube of claim 1 wherein said tubular member is fabricated from plastic.

4. The power tube of claim 1 wherein the outer surfaces of said member near the first end surface are champered.

5. The power tube of claim 2 wherein said vents are positioned within ¼ inch of the first end surface.

6. The power tube of claim 1 wherein tubular member is formed as a part of said bell.

7. The power tube of claim 1 wherein said tubular member is detachable from said bell.

* * * * *